United States Patent [19]

Falce

[11] 4,310,603

[45] Jan. 12, 1982

[54] DISPENSER CATHODE

[75] Inventor: Louis R. Falce, Redwood City, Calif.

[73] Assignee: Varian Associates, Inc., Palo Alto, Calif.

[21] Appl. No.: 75,349

[22] Filed: Sep. 13, 1979

Related U.S. Application Data

[62] Division of Ser. No. 964,867, Nov. 30, 1978.

[51] Int. Cl.[3] ..... H01J 19/06

[52] U.S. Cl. ..... 428/596; 313/346 R; 313/346 DC; 313/344; 313/355

[58] Field of Search ..... 313/346 R, 346 DC, 344, 313/355; 428/596

[56] References Cited

U.S. PATENT DOCUMENTS

| | | | |
|---|---|---|---|
| 2,874,077 | 2/1959 | Joseph et al. | 313/346 DC |
| 3,159,461 | 12/1964 | MacNair | 313/346 DC |
| 3,676,731 | 7/1972 | Hofmann et al. | 313/346 DC |
| 4,101,800 | 7/1978 | Thomas | 313/346 DC |

*Primary Examiner*—Brooks H. Hunt

*Attorney, Agent, or Firm*—Stanley Z. Cole; Peter J. Sgarbossa

[57] ABSTRACT

A dispenser cathode is fabricated by covering a reservoir of electron emitting material with a perforated metal foil having an appropriate pattern of pore-sized apertures thereon for providing uniform electron emission from the cathode surface. The electron emitting material is in the form of a pellet of barium oxide impregnated with a wax or resinous material to minimize chemical reduction of the barium oxide in air. The impregnated barium oxide pellet is sandwiched between the apertured foil and a support structure to which the foil is welded. During tube bake-out or subsequently during cathode activation, the wax or resinous material evaporates and barium oxide migrates through the apertures to cover the surface of the foil in a uniform manner. The desired pattern of apertures in the foil is achieved by photolithography, or by forming the foil (e.g., by chemical vapor deposition, sputter deposition, evaporation, or sintering) on a substrate containing an array of protruding posts. With the photolithographic technique, the desired pattern of apertures is chemically etched directly on the foil; and with the technique in which the foil is formed on a substrate having an array of posts, the substrate with its protruding posts is removed by chemical etching after the foil has been formed. With either technique for forming the apertures, a shadow grid can also be formed as an integral part of the cathode surface by depositing a layer of reactive material such as zirconium or graphite on a selected portion of the cathode surface. This layer of reactive material prevents the formation of an emitting layer of barium oxide on a selected pattern on the cathode surface.

14 Claims, 7 Drawing Figures

FIG. 1
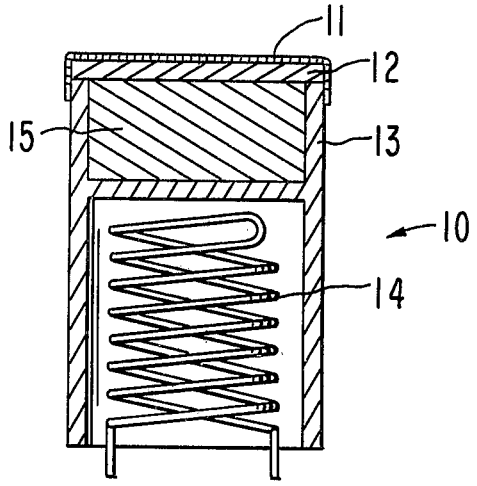
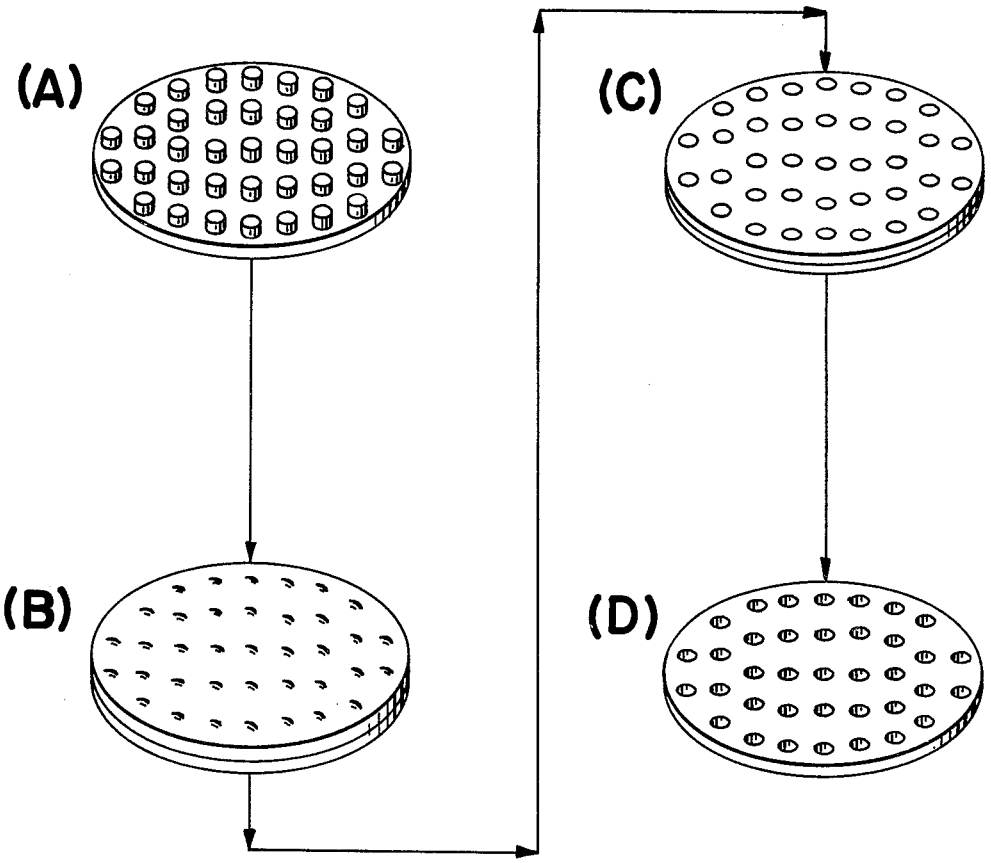
FIG. 2

DISPENSER CATHODE

This is a division of application Ser. No. 964,867 filed Nov. 30, 1978.

BACKGROUND OF THE INVENTION

This invention is a further development in the fabrication of dispenser cathodes, which find application generally in microwave tubes and linear beam devices.

Heretofore, the emitting surfaces of dispenser cathodes have been made either from porous metal matrices whose pores were filled with electron emitting material, or from porous metal plugs covering reservoirs of electron emitting material.

The porous metal bodies of prior art dispenser cathodes, whether they were matrices filled with electron emitting material or porous plugs covering reservoirs of electron emitting material, did not have consistently uniform pore size, pore length, or spacing between pores on the surface. As a consequence, dispenser cathodes of the prior art tended to exhibit non-uniform electron emission from their surfaces.

U.S. Pat. No. 4,101,800 (issued July 18, 1978) described a dispenser cathode comprising a reservoir of electron emitting material covered by a perforated metal foil. The pattern of perforations was such as to permit migration of electron-emitting material from the reservoir to the foil surface in such a way as to coat the surface uniformly, thereby providing a cathode surface of substantially uniform emissivity. The prior art has not, however, developed a practicable method for fabricating a perforated metal foil of the kind disclosed in U.S. Pat. No. 4,101,800. Consequently, the production of dispenser cathodes having uniform surface porosity has not heretofore been commercially feasible.

A further problem with such prior techniques has arisen from the conventional use of a barium carbonate starting material during fabrication, and its subsequent conversion into the barium oxide electron emitting material during cathode activation by heating. The carbonate thereupon converts to the oxide, giving off carbon dioxide gas. This results in the carborization or oxidation of the electron emitting metal surfaces; further, such carborized or oxidized surfaces then reduce the active barium oxide into elemental barium, which evaporates at tube operating temperatures.

SUMMARY OF THE INVENTION

It is an object of the present invention to provide a method for fabricating a dispenser cathode having a uniform surface porosity, whereby uniform electron emission from the surface can be achieved.

It is a concomitant object of this invention to provide a method for controlling the porosity of the surface of a dispenser cathode in order to provide a surface of uniform electron emission.

It is a further object of this invention to fabricate a dispenser cathode having uniform surface porosity by a method that minimizes carburization and oxidation of the cathode surface.

It is a particular object of the present invention to provide a method for fabricating a dispenser cathode having uniform pattern of electron emission from its surface in oxide form and impregnated to forestall chemical reaction in air by sandwiching a reservoir of electron emitting material between an apertured foil and a supporting structure using a bonding technique, minimizing carburization of the emitting surface.

In order to accomplish the aforementioned objects of this invention, a quantity of material having a low work function (e.g., barium oxide) is placed on a supporting structure, and a thin foil of refractory or platinum-group metal having a desired pattern of uniformly sized and evenly distributed apertures is placed on the support structure so as to cover the barium oxide. The foil is bonded to the support structure by laser welding so as to localize the heating effects due to the bonding process. In order to prevent chemical reaction of the barium oxide with moisture in the air during fabrication of the cathode, a specially treated pellet of barium oxide is used. This barium oxide pellet is formed by heating a solid pellet of barium carbonate in a vacuum to liberate carbon dioxide, thereby leaving a porous pellet of barium oxide. The porous pellet of barium oxide is then impregnated with a wax, or with a resinous material such as methyl methacrylate or nitrocellulose, to provide a protective coating over the barium oxide. Without such a protective coating, rapid chemical reduction of the barium oxide to barium hydroxide would occur. Barium hydroxide is not usable as an electron emitting material.

In the fabrication of a dispenser cathode according to the present invention, a pellet of barium oxide impregnated with a wax or a resinous material to prevent any rapid chemical reaction in air is placed on the surface a metal supporting member of the cathode structure. The apertured foil is placed over the barium oxide pellet, and is then welded to the metal supporting member. A laser welding technique is preferred because laser welding can be accomplished in areas of limited access, and effectively localizes the heating effects of the welding process. The heat generated during tube bake-out and processing, or during cathode activation, causes the wax or resinous protective material to evaporate from the barium oxide pellet.

The apertured metal foil of uniform pore size and distribution according to this invention may be obtained by a photolithographic technique whereby a pattern of holes is chemically etched in a foil of a refractory metal such as tungsten or molybdenum. After the holes have been formed, the foil is then coated with iridium, osmium or some other platinum-group metal. Typically, the tungsten or molybdenum foil is 0.001 inch thick, and the coating thereon is about one micron thick.

Alternately, a foil having a desired pattern of uniformly sized and distributed pores according to the present invention could be produced by deposition of a layer of a platinum-group metal onto a substrate having an array of appropriate dimensioned and spaced posts projecting therefrom. After the layer of metal has been deposited upon such a substrate, typically to a thickness in the range from 0.0005 inch to 0.0015, the substrate with its projecting posts is removed either by chemical etching or by evaporation. Deposition of the platinum-group metal layer onto the substrate could be accomplished by chemical vapor deposition, sputter deposition, electroplating or evaporation. Such techniques are well known to those skilled in the art. Alternatively, the metal layer could be formed by rolling fine particles of the metal (i.e., particles less than one micron in diameter) onto the substrate and subsequently sintering the articles to form a porous layer. The substrate could be made of any material amenable to photoetching or subsequent evaporation, whereby the posts could be formed by a photoetching process, and whereby the entire substrate with its projecting posts could subsequently be removed from the overlying foil by chemical etching and/or evaporation. Suitable substrate materials are molybdenum, aluminum and copper.

It is within the purview of the present invention to provide a shadow grid as an integral part of the foil covering the reservoir of electron emitting material. To accomplish this, the area of the foil destined to function as the shadow grid is coated with a non-emitting material such as zirconium or graphite. The non-emitting material coated onto specific non-perforated areas of the cathode surface suppresses electron emission from these areas and thereby functions in a manner analogous to a shadow grid in a non-intercepting grided gun.

Other methods for accomplishing the objects of this invention will become apparent to those skilled in the art upon a perusal of the following description of the preferred embodiment together with the accompanying drawing.

DESCRIPTION OF THE DRAWING

FIG. 1 is a cross-sectional view of a dispenser cathode according to the present invention.

FIG. 2 is a pictorial flow diagram illustrating a step-by-step process for fabricating a metallic foil having uniformly sized and spaced apertures for use as the emitting surface of a dispenser cathode.

DESCRIPTION OF THE PREFERRED EMBODIMENT

Figure 3:
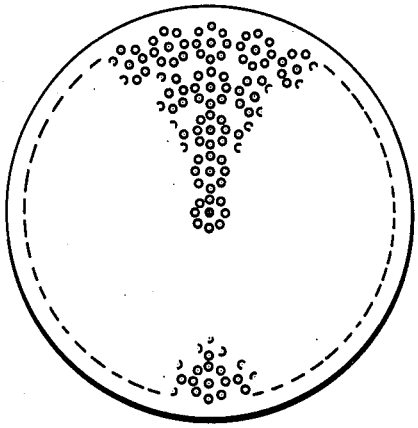
FIG. 3 is a plan view of a dispenser cathode emitting surface fabricated by the process illustrated in FIG. 2, with a shadow grid formed as an integral part of the emitting surface.

FIG. 1 shows a dispenser cathode 10 according to the present invention. The cathode structure comprises an electron-emitting surface 11 covering a reservoir 12 of thermionically emitting material such as barium oxide, or a mixture of barium oxide in combination with calcium oxide and/or strontium oxide.

The electron emitting surface 11 is an apertured metal foil supported on a hollow elongate member 13, which is mountable within an electron tube such as a klystron or a travelling wave tube. The support member 13 is made of a refractory material, and encloses a heater coil 14 that is made of a material such as tungsten that can dissipate electric power so as to achieve a temperature within the support structure 13 in the range from 800° to 1100° C. The support structure 13 may be made entirely of a refractory metal such as tungsten or molybdenum; or it may be a composite structure whose bottom portion is made of a refractory insulating material such as alumina or beryllia, and whose upper portion is made of a refractory metal.

As shown in FIG. 1, the upper portion of the support structure 13 is configured to retain a block 15 of refractory metal such as tungsten, tantalum, or a porous tungsten-impregnated material. The block 15 need not be a separate member, but could be fabricated as an integral part of a homogeneous support structure 13.

On the upper surface of the refractory metal block 15, the reservoir 12 of material that emits electrons by thermionic emission at temperatures above 700° C. is provided. The reservoir 12 would typically comprise a layer of barium oxide. However, as discussed above, the reservoir layer 12 could also comprise a mixture of barium oxide in combination with calcium oxide and/or strontium oxide, depending upon the particular use intended for the tube in which the dispenser cathode 10 is to be mounted. On top of the reservoir layer 12, the metal foil 11 is disposed. The foil 11 is arranged as a cap structure retaining the reservoir layer 12 in position. The foil 11 is bonded to the outside vertical wall of the support structure 13 by an appropriate technique such as laser welding, which localizes the heating effects of the bonding technique so as to minimize chemical decomposition of the electron-emitting material constituting the reservoir layer 12.

Barium oxide, when exposed to air, is quickly converted to barium hydroxide by the moisture in the air. Barium hydroxide, which melts at 78° C., is ineffective as a thermionic electron-emitting material. Hence, the application of a barium oxide layer to the surface of a cathode has heretofore required rigid control of the environment in which fabrication takes place.

According to the present invention, the barium oxide reservoir layer 12 is applied to the top surface of the refractory metal block 15 by the following technique. First, a solid pellet of barium carbonate is heated in a vacuum to liberate carbon dioxide, leaving barium oxide according to the equation $BaCO_3 \rightarrow BaO + CO_2$. The pellet of barium oxide that remains after the carbon dioxide has been liberated is quite porous. Next, the porous barium oxide pellet, while still under vacuum, is impregnated with a wax such as eicosane, or a resinous material such as methyl methracrylate or nitrocellulose. This wax or resinous coating, which permeates the barium oxide pellet, protects the pellet from hydration in moist air. Such coated pellets can easily be fabricated in desired quantities by well-known techniques: e.g., in an inert atmosphere by back-filling a vacuum chamber with argon.

A wax-impregnated or resin-impregnated barium oxide pellet is then placed on the surface of the refractory metal block 15. The apertured metal foil 11 is then disposed to cover the barium oxide pellet; and the perimeter of the foil 11 is then sealed to the outer wall of the support structure 13 by laser welding. Later, during the tube bake-out or during the cathode activation process, the heat thereby produced causes the wax or resinous protective material to evaporate from the pellet through the apertures in the foil 11. By this technique, not only can the barium oxide electron-emitting layer 12 be applied under ordinary atmospheric conditions, but also the layer 12 can be heated to operating temperatures without causing carburization or oxidation of the surface of the foil 15.

Using prior techniques, carburization or oxidation of the emitting surface could be caused by the release of carbon dioxide gas during cathode activation. In the prior art, the conventional method of applying a layer of barium oxide to the surface of a cathode involved covering a quantity of barium carbonate with a porous foil and then welding the foil to a support structure.

Subsequent activation of the cathode by heating to 900° C. would convert the barium carbonate to barium oxide, thereby driving off carbon dioxide gas. This carbon dioxide gas would react with adjacent metal surfaces (including the electron-emitting surface) to cause carburization or oxidation thereof. Furthermore, the carburized surface would act as a reducing agent for the barium oxide, thereby generating elemental barium that would evaporate at operating temperatures of the cathode. With the technique of the present invention, on the other hand, there is no carbon dioxide to be liberated from the wax- or resin-impregnated barium oxide pellet. Thus, the possibility of carburization or oxidation of the surface of the foil 11 by the formation of the barium oxide reservoir layer 12 is eliminated.

In order to provide a uniform electron emission density over the surface of the foil 11, a pattern of apertures of uniformed size and of uniform distribution with respect to each other are formed on the foil surface. Such uniform porosity of the foil 11 is achieved according to the present invention by fabricating the foil 11 according to one of the following techniques:

(1) Photolithography: A pattern of uniformly dimensioned and spaced holes is chemically etched through a foil that is made of a refractory metal such as tungsten or molybdenum, preferably about 0.001-inch thick. Thereafter, a coating of iridium, osmium or other platinum-group metal is deposited to a thickness of about one micron on one surface (i.e., the upper surface) of foil. This coating of iridium or other platinum-group metal serves to enhance emissivity.

(2) Deposition on a Substrate: A layer of refractory metal or platinum-group metal is deposited upon a substrate by chemical vapor deposition, sputter deposition, electroplating or evaporation. The material from which the substrate is made depends upon the deposition technique used. The substrate is configured to have a flat surface with evenly spaced posts protruding therefrom, the posts having been formed by a conventional photolithographic and chemical milling technique. Preferably, the thickness of the substrate, exclusive of the protruding posts, is about 0.01 inch. The posts are generally cylindrical, with a diameter in the range from 0.0005 inch to 0.0010 inch, and extend about 0.0010 inch to 0.0015 inch above the flat surface of the substrate. In the usual embodiment, the posts are separated by about 0.002 inch from center to center.

The second technique described above for fabricating uniformly apertured metal foil for use in a dispenser cathode is illustrated in the pictorial flow-diagram of FIG. 2. At step A, a substrate having an array of posts protruding therefrom is pictured. The posts are uniformly dimensioned and uniformly spaced with respect to each other, and are produced on the substrate by a conventional lithographic technique and by chemical milling. At step B, the substrate of step A is shown coated with a layer of refractory metal or platinum-group metal. The particular type of coating process used would depend upon the nature of the substrate material. At step C, the coated substrate of step B is shown after having been polished to achieve a metal layer of uniform thickness with the substrate posts flush with the upper surface of the metal layer. Polishing may be done by a conventional method such as surface grinding. At step D, the metal layer produced at step C is shown with the substrate (including its projecting posts) having been removed. The substrate can be removed by a conventional method such as chemical etching or evaporation, depending upon the nature of the substrate material.

The metal foil remaining after the substrate has been removed, as pictured at step D in FIG. 2, has an array of holes of predetermined size and spatial distribution. This foil is used to cover the barium oxide reservoir 12, as shown in FIG. 1, and provides the desired electron-emitting pattern from the surface of the dispenser cathode. During cathode activation, barium oxide migrates up through the apertures in the foil 11 and coats the entire surface thereof by a diffusion process known as Knudsen flow. In this way, the non-perforated surface of the foil 11 becomes a thermionic electron source of substantially uniform surface emissivity.

(3) Sintering: The formation of a metallic foil on the surface of a substrate could also be accomplished by the sintering of fine particles of a refractory or platinum-group metal onto the surface of the substrate.

A porous metallic foil fabricated according to this invention can also be treated so as to provide a pattern of non-emitting portions on the upper surface of the foil. Thus, after a foil of uniform porosity has been fabricated according to the process described above in connection with FIG. 2, a pattern of non-emitting surface areas can then be superimposed upon selected portions of the upper surface of the foil to function in a manner analogous to a shadow grid in a non-intercepting gridded gun. These non-emitting areas comprise a coating of an oxygen scavenging material such as zirconium or graphite, which can be deposited upon the surface of the foil by sputter deposition or any other appropriate technique known to those skilled in the art.

Figure 6:
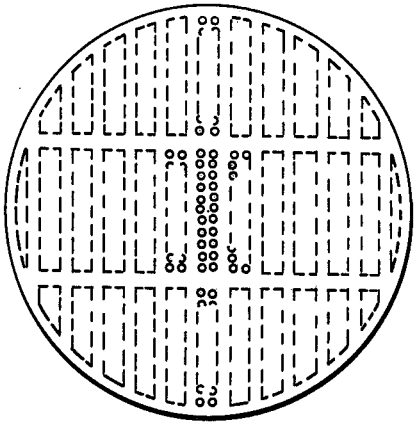
FIG. 6 is a plan view of yet another dispenser cathode as in FIG. 3, with a further alternative design for the shadow grid.
Figure 4:
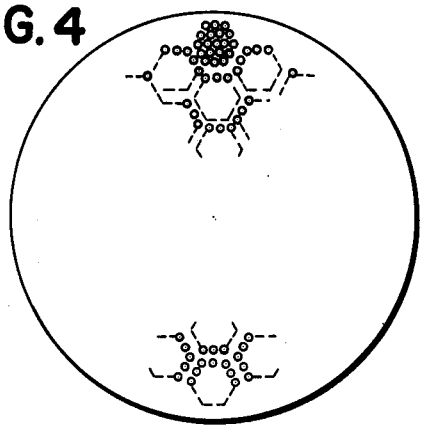
FIG. 4 is a plan view of a dispenser cathode as in FIG. 3, with an alternative design for the shadow grid.
Figure 5:
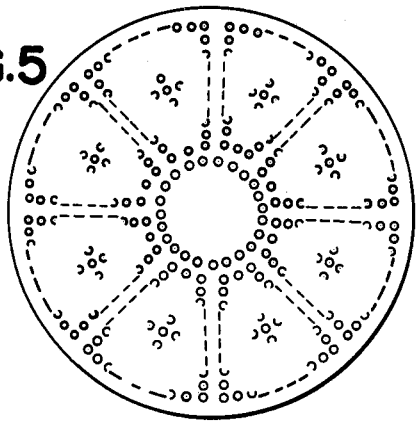
FIG. 5 is a plan view of another dispenser cathode as in FIG. 3, with another alternative design for the shadow grid.

The configuration of the shadow grid portion of the foil can be selected in accordance with the application for which the tube is intended. In FIG. 3, the shadow grid is configured as a pattern of circles, which is representative of shadow grid patterns used in klystron tubes. In FIG. 4, the shadow grid is configured as a pattern of hexagons, which represents another type of shadow grid pattern used in klystrons and also in travelling wave tubes. In FIG. 5, a radial vane configuration for the shadow grid pattern is shown, which provides an advantage with respect to thermal conductivity. In FIG. 6, the shadow grid comprises an array of bars.

Figure 7:
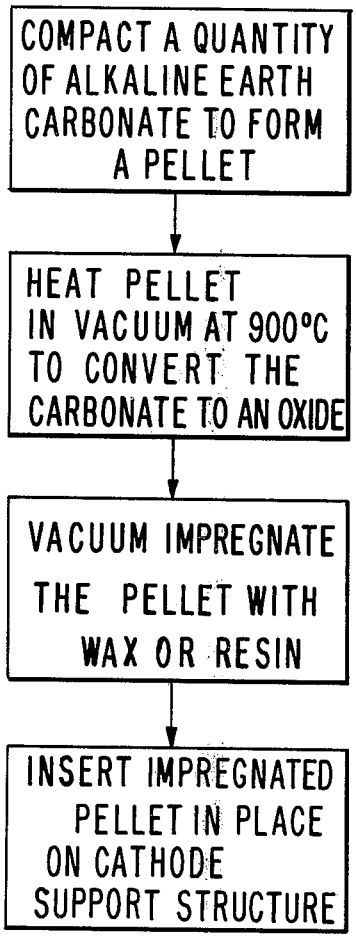
FIG. 7 is a flow diagram summarizing the step in the fabrication of a reservoir of thermionically emitting material according to the present invention.

The steps in the fabrication of the layer 12 of thermionically emitting material according to the present invention are summarized in the flow diagram of FIG. 7. First, a quantity of alkaline earth carbonate material is compacted to form a pellet. This pellet is then heated in a vacuum at 900° C. to convert the carbonate to an oxide by driving off carbon dioxide. In the case of a barium carbonate pellet, the heating converts the barium carbonate pellet to a porous pellet of barium oxide. This resulting oxide pellet is then impregnated in a vacuum with a wax or with a resinous material. Finally, this impregnated oxide pellet is placed on the block 15 at the top of the cathode support structure 13, and is covered with the perforated foil 11.

The steps in the fabrication of a dispenser cathode according to the present invention may be summarized as follows:

(1) The heater 14 is assembled in the cathode structure 13.

(2) The protected (i.e., wax- or resin-impregnated oxide pellet is inserted in place on the support structure 13 to form the reservoir 12 of election-emitting material.

(3) The perforated foil 11 is placed over the protected oxide pellet.

(4) The perimeter of the perforated foil 11 is laser welded to the support structure 13 so as to sandwich the oxide pellet between the foil 11 and the support structure 13.

This invention has been described above in terms of a particular embodiment. However, from a reading of the above disclosure, other techniques for optimizing the desired electron emitting pattern from the surface of a dispenser cathode will suggest themselves to those skilled in the art. Consequently, the invention is limited only by the following claims.

What is claimed is:

1. The dispenser cathode wherein said foil is made of tungsten.

2. The dispenser cathode of claim 1 wherein said foil is made of molybdenum.

3. The dispenser cathode of claim 1 further comprising a coating of metal on the surface of said foil to enhance electron emissivity, said coating being applied to said foil by the process of deposition after said apertures have been chemically etched on said foil.

4. The dispenser cathode of claim 1 wherein said coating to enhance electron emissivity comprises a layer of iridium.

5. The dispenser cathode of claim 1 wherein said coating to enhance electron emissivity comprises a layer of osmium.

6. A dispenser cathode for use in a electron tube comprising:

a compacted pellet of alkaline earth oxide, substantially free of carbon-dioxide-emitting substances, and impregnated with a protective coating to secure said oxide from chemical reaction with the air, said coating being evaporable at elevated temperatures;

a support structure;

and a perforated foil of a refractory metal affixed to said support structure and sandwiching said pellet between said foil and said structure, whereby upon activation of said cathode by heating to said elevated temperatures after assembly to said tube, said protective coating evaporates and carburization of the components of the cathode is avoided.

7. A dispenser cathode as in claim 6 in which said pellet is made by the process of heating a compacted body of alkaline earth carbonate in an inert environment to drive off carbon dioxide and obtain a porous body of alkaline earth oxide comprising said pellet, and impregnating said pellet with said protective coating in an inert environment.

8. A dispenser cathode as in claim 6 in which said protective coating comprises a resinous material.

9. A dispenser cathode as in claim 8 in which said resinous material comprises methyl methacrylate.

10. A dispenser cathode as in claim 8 in which said resinous material comprises nitrocellulose.

11. A dispenser cathode as in claim 6 in which said protective coating comprises a wax.

12. A dispenser cathode as in claim 11 in which said wax comprises eicosane.

13. A dispenser cathode as in claim 6 in which said alkaline earth oxide includes one or more of the following: barium oxide, strontium oxide, calcium oxide.

14. A dispenser cathode as in claim 6 in which said foil is fabricated by (a) depositing a coating of metal upon a substrate configured to have a flat surface with posts protruding therefrom; (b) polishing said coated substrate in order to obtain a metal layer of uniform thickness with said posts of said substrate being flush with the upper surface of said metal layer and (c) removing said substrate, including the projecting posts of said substrate.

* * * * *